US005593726A

United States Patent [19]

Nicholls et al.

[11] Patent Number: 5,593,726

[45] Date of Patent: Jan. 14, 1997

[54] HOT ISOSTATIC PRESSING PROCESS FOR APPLYING WEAR AND CORROSION RESISTANT COATINGS

[75] Inventors: John R. Nicholls, Flitwick; David J. Stephenson, Cranfield; Geoffrey F. Archer, Werrington, all of England

[73] Assignee: APV Corporation Limited, England

[21] Appl. No.: 238,819

[22] Filed: May 6, 1994

Related U.S. Application Data

[63] Continuation of Ser. No. 947,004, Sep. 18, 1992, abandoned, which is a continuation of Ser. No. 697,882, May 9, 1991, abandoned.

[30] Foreign Application Priority Data

May 10, 1990 [GB] United Kingdom ..... 9010549
Dec. 19, 1990 [GB] United Kingdom ..... 9027543

[51] Int. Cl.[6] ..... B05D 3/02

[52] U.S. Cl. ..... 427/189; 427/190; 427/191; 427/226; 427/376.6; 427/380; 427/383.5; 427/383.7

[58] Field of Search ..... 427/189, 190, 427/191, 376.6, 226, 380, 383.5, 383.7

[56] References Cited

U.S. PATENT DOCUMENTS

| | | | |
|---|---|---|---|
| 3,754,968 | 8/1973 | Reznik | 29/194 |
| 4,351,858 | 7/1982 | Hunold et al. | 427/189 |
| 4,851,188 | 7/1987 | Schaefer et al. | 419/19 |

FOREIGN PATENT DOCUMENTS

| | | | |
|---|---|---|---|
| 0005285 | 11/1979 | European Pat. Off. | C23C 7/00 |
| 867455 | 5/1961 | United Kingdom . | |
| 1248503 | 10/1971 | United Kingdom | C23C 7/00 |
| 1354262 | 5/1974 | United Kingdom | B44B 1/02 |

*Primary Examiner*—Benjamin Utech
*Attorney, Agent, or Firm*—Quarles & Brady

[57] ABSTRACT

A method of producing a wear or corrosion resistant coating by forming a coating of grains of hard metallic alloys bonded with an organic binder. The coating is applied to a substrate, heated so that the binder decomposes and then isostatically hot pressed. No liquid phase is formed in the coating during the process.

22 Claims, No Drawings

HOT ISOSTATIC PRESSING PROCESS FOR APPLYING WEAR AND CORROSION RESISTANT COATINGS

This application is a continuation of U.S. patent application Ser. No. 07/947,004, filed Sep. 18, 1992 now abandoned which is a continuation of U.S. patent application Ser. No. 07/697,882, filed May 9, 1991, now abandoned.

BACKGROUND OF THE INVENTION

1. Field of the Invention

This invention relates to a process for applying a wear and/or corrosion resistant coating to at least a portion of a metal and/or ceramic object. Thus the resistance may be resistance to mechanical abrasion but it may be resistance to corrosion, or any combination thereof.

The invention relates particularly, but not exclusively, to the application of a coating of hard alloys, metallic alloys, inter-metallic compounds, cermets, or ceramic materials or combinations thereof (hereinafter referred to as a special coating material) to a metal object.

2. Brief Statement of the Prior Art

Various proposals have been made and processes developed for applying a wear-resistant coating to tools, drill bits for example.

Specification no. GB 867,455 is concerned with a development of a spray-welding process in which a metal is sprayed onto a surface to be coated and the coating is then fused in place. The material to be sprayed is fed into a heating zone where it is melted or heat-softened, and from which it is then propelled in finely divided form, in a molten or heat-plastic condition onto the surface to be coated. The material being fed to the heating zone can be in the form of a powder or as a powder bonded together by a plastic material to form a wire. The fusing operation is performed in a furnace, or by means of heating torches applied directly to the coated surfaces. The development described was to employ a self-fluxing alloy in conjunction with a carbide in the form of a 'fused aggregate'.

It was found that flame- or plasma-sprayed coatings were often of a porous nature and were not always bonded well to the substrate. Various attempts have been made to overcome these problems over a period of many years.

Specification no. EP 0,005,285A disclosed a process for applying a dense, hard and wear-resistant layer of cermets or ceramic material to a metal object by spraying-on of a matrix material and hard particles of cermets or ceramic material, followed by consolidation of the sprayed-on layer at high temperature and pressure, in which the sprayed-on layer is consolidated by isostatic compacting at a temperature of at least 1,000° C., and a pressure of at least 1,000 bars, for at least half-an-hour. The consolidation step leads to a significant reduction in the porosity of the sprayed-on layer and, for many compositions of coatings, this and new compounds formed can lead to a more durable coating.

The process of EP 0,005,285A employs a binder metal of cobalt and/or nickel.

BRIEF STATEMENT OF THE INVENTION

The present invention stems from our work to devise improved coatings and coating processes primarily for components of food processing machinery. As is well-known, there are restrictions on the metallurgy of surfaces which come into contact with food materials. The wear and corrosion regimes for such machinery components can be very different from those for many other coated components.

According to one aspect of our invention a method of producing a wear and/or corrosion resistant coating, as hereinbefore defined, on a metal and/or ceramic substrate comprises bonding together with an organic binder the special coating material, as hereinbefore defined, in powder form to provide a bonded layer on the substrate, subjecting the bonded layer to a first heating step during which the binder is decomposed, and subjecting the bonded layer to a second heating step in conjunction with the application of isostatic super-atmospheric pressure to consolidate the coating.

There may or may not be a cooling step between the first and second heating steps.

DESCRIPTION OF THE PREFERRED EMBODIMENTS

By a 'bonded layer' we mean a layer of the powdered material in which the powder grains themselves have been stuck together by the organic binder. That layer will often be bonded to the metal substrate but it need not always be so attached. The bonded layer may, indeed, be pre-formed prior to manufacture of the metal component to be coated and the resulting pre-form can be stored and then used when the component is available and requires coating.

The binder may be any organic material which is capable of bonding together the cermet and/or ceramic material powder. Long-chain hydrocarbons such as polymers will often be suitable. The carbon produced on decomposition of the binder can be beneficial to the properties of the coating, or often to the outer layer of the substrate (but is will be appreciated that, following the heating step at high pressure, there will often be no precise boundary between what was the substrate material and the coating itself). The strength of the temporary bond required will depend upon the degree of any subsequent handling of the bonded layer. Of course, when the bonded layer is prepared as a pre-form to be applied later to the component, the bonding will need to be relatively durable to facilitate storage and handling of the pre-form.

The use of an organic binder can have substantial advantages over the use of a binder metal as used in the usual metal spraying techniques, since the organic binder need only contribute carbon to the resulting coated substrate. Thus, for food processing components there is no problem, as would be the case with non-food compatible metallic binders.

The inventive process also has substantial advantages over flame-/plasma-spraying techniques in that, in the inventive process, it is generally much easier to control the formation of the bonded layer.

With the flame-/plasma-spraying techniques, much of the sprayed material is lost, either because it never impacts with the metal object being sprayed, or because it bounces off of the metal object. Typically, only 30% of the very expensive material being sprayed goes to form the coating, and under the most favourable conditions a maximum of about 70% is achievable. The inventive process can easily result in a utilisation of essentially all of the special coating material, thus providing an important cost benefit.

A wide range of techniques may be employed to create the bonded layer of powder material.

When the layer is produced directly on the metal object to be coated, slip casting is a very convenient and cheap technique to employ. The powder material is mixed with the organic binder in a suitable binder carrier, and the metal object is simply dipped into the mixture to collect a layer of the mixture. The carrier is then allowed to evaporate, if necessary by the use of forced convection and/or heating. Further layers of the same or of different such mixtures can be applied as is required.

This illustrates an important advantage of the inventive process, that a plurality of layers of different coating materials may be applied without difficulty to provide an overall coating layer having either a step-wise or a gradual change of chemical composition with depth.

It will be appreciated that a quite complex sub-layer grading can be achieved simply by having several vessels containing different mixtures into which the component to be coated is dipped in turn.

For large components, a spraying technique could be employed to apply the mixture using, for example, a suitably modified paint spray gun.

The mixture may also be applied with a brush or suitable roller, pad or other mechanical applicator.

It would also be possible to rain the powder material onto a metal object that has first been wet with the organic binder. If a plurality of layers of the material was required, it would be necessary to wet the partially coated object between the raining stages, the intermediate wetting step/s being accomplished in any convenient manner, for example by paint spraying the organic binder or by dipping, following a first drying of the previous layers.

Another method of applying the powder material to the metal object would be to press on a layer of a mixture comprising the powder material and organic binder. The layer may, if necessary, be held in place on the metal object during setting of the binder. With this method of application the organic binder is preferably of the type which sets without evaporation of a binder component, such as a self-curing adhesive.

Such a pressing operation may instead be performed on said powder material which has been treated to provide a coating of organic binder on the individual grains.

We are aware that organic adhesive binders have been used to hold together the particles of an integral sintered component, prior to the sintering process.

We are also aware that specification no. GB 1,248,503 proposed the production of a coating on a piston ring of up to a few tenths of a millimetre by spraying or electrolytic deposition or by means of adhesive, the applied layer being subsequently melted with an electron beam.

Whilst the inventive process might in some circumstances be employed to apply coatings as thin as a few tenths of a millimetre, more usually the coatings will be substantially thicker. The layer applied will often be several millimetres in thickness, and could even be as thick as the base metal component itself for some objects. In many cases it will be desirable to machine the coated component, after the coating process is completed and, accordingly, the thickness of the applied layer needs to include an allowance for such machining.

Specification no. GB 1,354.262 has proposed liquid phase sintering of a coating, but there is no reference to the use of a hot isostatic stage.

When the coating layer is produced as a pre-form, then any convenient method may be used to create the pre-form. For example, a moulding process may be used, but any of the previously mentioned coating application methods may be used but, instead of applying the coating directly to a metal object, the coating is applied to a master former which could, for example, be of metal, plastics or ceramic material. Of course, a suitable agent would need to be applied to the former to permit separation of the pre-form from the former.

The pre-form would usually consist of pre-form sections that can be fitted together on the surface or surface portion of the metal object to be coated.

It will be appreciated that the formation of the bonded layer can usually be performed at normal temperatures, or at least without very high temperatures. With plasma-/flame-spraying, on the other hand, the material being sprayed is subjected to very high temperatures. Depending upon the compositions of the material being sprayed, the use of very high temperatures can produce volatilisation or chemical modification of some components, with the result that those components are substantially depleted or undesirably modified in the resulting coating. For example, tungsten, molybdenum, niobium, tantalum, zirconium, titanium and hafnium will generally be affected or severely depleted. The inventive processes enable a very much wider range of materials to be used in the coating and, accordingly, this can be a major advantage of the inventive process.

The isostatic pressing operation can be undertaken by containing the metal object with bonded layer, or at least a surface portion to be coated, in a sealed metal jacket which is then subjected to an inert gas under high pressure and at a high temperature. The jacket is preferably a close fit on the metal object with its special coating but, in some cases, it would be possible to immerse the object with its special coating in a suitable inert pressure-transmitting medium contained in the jacket.

When the jacket is a close fit on the object with coating, the thickness of the jacket is preferably greater than substantially 1.25 min. Typically, a metal jacket of 1.6 mm thickness is employed.

It is essential that the jacket is gas-tight to permit the hot isostatic pressing operation to be performed. It is good practice to conduct a preliminary heating and pressure cycle to test the integrity of the jacket, and this preliminary heating step will conveniently decompose the binder. The jacket will also be urged inwardly to hold the bonded layer to the metal object. The jacket is desirably made sufficiently thick that, on completion of the preliminary heating and pressure cycle, the jacket can support the bonded layer on the object whilst the object awaits the main hot isostatic pressing operation.

It is often desirable to evacuate the jacket prior to the main pressing cycle. According to a preferred feature of the invention, the preliminary heating step may be performed during the evacuation process, with the advantage of some saving in time, and removal of some binder residues in suitable cases.

One or more elements may diffuse into the substrate material from the special coating material and/or binder. This can be used to advantage in that the composition of the substrate may be improved. For example, the strength of the substrate may be increased. This can allow the use of a more manageable substrate material to be used up to the coating stage. For example, carbon from the binder may diffuse into the substrate.

The coating material is very desirably chosen to be suitable for solid state sintering, as opposed to liquid phase sintering.

With liquid phase sintering of a coating, such as in the process described in specification GB 1,354,262, the coating will tend to run off the component, particularly when a relatively thick coating is being applied.

The special coating material for use in the method according to the first aspect of the invention comprises by weight 6 to 25% of chromium, molybdenum, tungsten, tantalum, niobium, titanium, hafnium or zirconium, or a mixture thereof, 0 to 2% of carbon in powder form (ie in addition to carbon from the organic binder). 0 to 5% boron, or equivalent amounts of silicon or iron, 0 to 3%, silicon, 0 to 10% aluminium. 0 to 1% of a rare earth element/s such as cerium and yttrium, particulate material such as tungsten carbide, the balance being nickel, cobalt or iron.

Such a coating material is particularly suitable for solid state sintering which we consider to be particularly important.

In general liquid phase sintering has been preferred in the past in preference to solid state sintering, probably because densification can be achieved by liquid phase sintering without the need to apply an external pressure. The presence of a liquid phase has also assisted in the application of a powder to a substrate by processes such as flame spraying, prior to a densification step.

We prefer to avoid liquid phase formation because the microstructure produced as a result is often unsuitable for many applications; the coating properties are not optimised and undesirable phases may be formed. The use of a solid state sintering process can enable optimum control over the resulting microstructure.

We prefer to operate the solid phase sintering process at temperatures which are substantially as high as possible yet avoiding the production of a liquid phase.

Thus, we prefer to process under conditions of maximum temperature but chosen such that after processing there is substantially no evidence of any liquid phase having been present during processing. The usual forms of inspection involving the production of a micrograph are used in trials to look for evidence of a liquid phase when determining the process conditions to be employed on a production item.

The use of high temperatures encourages certain desirable components of the coatings to be developed. For example, a substantially uniform distribution of fine carbides in the coating is encouraged by the use of high temperatures.

A second aspect of the invention is a metal and/or ceramic object of which the surface, or a portion thereof, has been coated by a special coating, as hereinbefore defined, applied by the method in accordance with the first aspect of the invention.

A third aspect of the invention is a pre-form for coating a metal and/or ceramic object by the method in accordance with the first aspect of the invention, the pre-form comprising a shell of a special coating material, as hereinbefore defined, having a shape to fit a surface of a metal and/or ceramic object to which the shell is to be applied for coating the surface, the shell comprising the special coating material in powder form that has been bonded together by an organic binder.

EXAMPLES

Some examples of the process conditions for processes in accordance with the invention will now be given:

Binders 1. polystyrene in a carrier of ethyl acetate
2. poly vinyl acetate (PVA) in a carrier of ethyl acetate (or various alcohols)
3. poly vinyl acetate in water
4. cellulose
5. latex Special Coating Material By weight:

12% Cr 2.5% Bo 2.5% Si 2.5% Fe

35% a component consisting of tungsten carbide clad in nickel, the amount of nickel being 8% by weight of the component.

Balance Ni

The range of possible compositional changes relative to that particular example will now be discussed, each component being dealt with in turn.

Chromium can be present in the range 6–25%. Chromium goes to form chromium carbides in the matrix material of the resultant coating. Where corrosion resistance is required, a sufficient amount of chromium should be provided to supply residual chromium for forming a passive chromium-rich oxide. Of course, the chromium carbide formed in the matrix provides a contribution to wear resistance. Also some chromium forms one of the inter-metallic components of the matrix. The chromium carbide also contributes to wear resistance. In general chromium strengthens the matrix.

Chromium can be replaced wholly or in part by molybdenum, tungsten, niobium, titanium, hafnium or zirconium, or by combinations thereof. Of course, the weight percentage figure would need to be adjusted according to the atomic weight of the substituted component.

Boron can be present in the range 0 to 5%. Boron forms tough boride phases based on nickel, chromium, iron and cobalt and combinations thereof.

Boron can be replaced in part or in whole by silicon or iron, but boron is of particular value since all elements capable of forming carbides are also capable of forming borides.

Cobalt could be included (but not in food processing machinery) to contribute to matrix strength.

Silicon can be present in the range 0–3% (this is in addition to any silicon which might be used instead of the boron component).

Silicides provide low melting point phases and, since we do not want a liquid phase, the amount of silicon is best minimised. However, the silicon has the benefit that it can provide a passive layer to improve corrosion resistance, and may sometimes be desirable.

Carbon in powder form can be present in the range 0 to 2% this is in addition to carbon which comes from the organic binder). The carbon may form carbides with inter-metallic components, particularly with chromium or refractory metal additions.

Aluminium can be present in the range 0–10%. Aluminium can provide inter-metallic strengthening and passivation.

Particulates are present in the range 0–94%. Whilst tungsten carbide clad in nickel can be employed, the nickel cladding is not always required; unclad tungsten carbide can be used in some circumstances.

Tungsten carbide clad in cobalt may be used.

It is to be noted that solid phase processing as provided by the invention means that little reaction takes place between the matrix and the particulate material as compared with the reactions which would take place if the matrix entered the liquid phase. Such reactions could adversely affect both the matrix and the particulate material.

Balance. The balance, ie the matrix metal, can be nickel, cobalt or iron, or combinations thereof.

Trace Elements. Rare earth elements such as cerium and yttrium can be present in the range 0 to 1%, typically 0.3%.

A further example of a special coating material in accordance with the invention is as follows, (by weight):

11.85 Cr 2.1 B 2.2 Si 2.3 Fe 0.42 C

35% nickel clad tungsten carbide, of minimum dimensions typically at least 45 to 150 micron Balance Ni Coatings produced in accordance with the first aspect of the invention (apart from those containing cobalt) are particularly suitable for use on the components of food processing machinery, such as on the extruder barrel wall of a twin-screw extruder.

Hot Isostatic Consolidation—Precurser (Test containment and conversion of organic binder)—Typical Cycle The temperature of the heat and pressure furnace is increased at a rate of 4° C. per minute up to a soak temperature of 700° C. and the furnace is held at this temperature for 20 minutes, after which the temperature is reduced at a rate of approximately 7° C. per minute. A pressure of 200 bar is maintained during the soak period at temperature.

Main Cycle (Typical Cycle)

Heat at 4° C. per minute to between 800° C. and 1,500° C. and hold for between 10–100 minutes at between 500–1,500 bar pressure. Cool at typically 10° C. per minute. The exact temperature and pressure cycle will depend on the particular special coatings being processed.

Main Cycle (Modifications)

We now propose modifications to the above process conditions in which the item being coated is held at a temperature of between 900° C. and 1,000° C. for a period of between 30 and 500 minutes at pressure, and the item is then cooled at typically 30° C. to 2° C. per minute.

We claim:

1. A method of producing a coating resistant to at least one of wear and corrosion on a surface of a substrate made of at least one of metal and ceramic, said coating being produced from a coating material, said coating material comprising hard metallic alloys, said method comprising the steps of:

providing a layer of powder grains of the coating material in powder form bonded together with an organic binder;

subjecting said layer of bonded powder grains and said binder to a first heating step at a first temperature during which said binder is decomposed, whereby a rudimentary coating comprising said powder grains and decomposed binder is formed on said surface; and subjecting said rudimentary coating on said surface to a second heating step being conducted in conjunction with the application of isostatic super-atmospheric pressure to densify said rudimentary coating by isostatic hot pressing of said powder grains and to permanently adhere the densified rudimentary coating to said surface to form said resistant coating, wherein no liquid phase is produced in the layer of the powder grains during the first heating step or the second heating step.

2. A method as claimed in claim 1, wherein the second heating step provides solid phase sintering.

3. A method as claimed in claim 2 in which the process temperatures employed in the second heating step are as high as possible yet avoid the production of a liquid phase.

4. A method as claimed in claim 2 in which the coating material comprises by weight 6 to 25% of chromium, molybdenum, tungsten, tantalum, niobium, titanium, hafnium or zirconium, or a mixture thereof, 0 to 2% of carbon in addition to carbon from the organic binder, 0 to 5% boron, 0 to 5% silicon, 0 to 5% iron, 0 to 10% aluminum, 0 to 1% of a rare earth element, 0 to 94% particulate carbide material, the balance being nickel, cobalt or iron.

5. A method as claimed in claim 1 in which the organic binder comprises a long-chain hydrocarbon.

6. A method as claimed in claim 5 in which the binder comprises a polymer.

7. A method as claimed in claim 6 in which the binder comprises a vinyl polymer.

8. A method as claimed in claim 1 in which the layer is formed in situ on the metal substrate.

9. A method as claimed in claim 1 in which a mixture is produced of the organic binder, the powder material and a binder solvent, and a slip casting process is employed to apply the mixture to the substrate.

10. A method as claimed in claim 1 in which a plurality of superimposed layers of said coating material are applied to the substrate, the layers differing in composition.

11. A method as claimed in claim 1 in which the layer is produced as an independent pre-form and the pre-form is then assembled to the substrate prior to the heating steps.

12. A method as claimed in claim 1 in which the heating steps are performed while the substrate with said layer is mounted in a gas-tight jacket, the jacket being a close fit on the layer at least during the second heating step.

13. A method as claimed in claim 1 wherein carbon resulting from decomposition of the binder during the first heating step diffuses into said substrate during said second heating step.

14. A method as claimed in claim 1, in which said first and second heating steps are performed without an intermediate cooling step.

15. A method of producing a coating resistant to at least one of wear and corrosion from a coating material comprising hard metallic alloys on a surface of a substrate made of at least one of metal and ceramic, comprising:

providing a layer of powder grains of the coating material in powder form bonded together with said organic binder on said surface;

subjecting said layer of bonded powder grains to a first heating step during which said binder is decomposed, whereby a rudimentary coating comprising said powder grains and decomposed binder is formed on said surface; and subjecting said rudimentary coating on said surface to a second heating step, said second heating step being conducted in conjunction with the application of isostatic super-atmospheric pressure to densify said rudimentary coating by isostatic hot pressing of said powder grains and to permanently adhere the densified rudimentary coating to said surface to form said resistant coating, in which the coating material has substantially the following composition by weight:

11.85% Cr 2.1% B 2.2% Si 2.3% Fe 0.42% C

35% nickel clad tungsten carbide, of minimum dimensions at least 45 microns 46.13% Ni.

16. A method of producing a coating resistant to at least one of wear and corrosion on a surface of a substrate made of at least one of metal and ceramic from a coating material comprising hard metallic alloys, comprising:

providing a layer of powder grains of the coating material in powder form bonded together with said organic binder on said surface;

subjecting said layer of bonded powder grains to a first heating step during which said binder is decomposed, whereby a rudimentary coating comprising said powder grains and decomposed binder is formed on said surface; and subjecting said rudimentary coating on said surface to a second heating step, said second heating step being conducted in conjunction with the application of isostatic super-atmospheric pressure to densify said rudimentary coating by isostatic hot pressing of said powder grains and to permanently adhere the densified rudimentary coating to said surface to form said resistant coating, in which the thickness of the layer is at least 1 millimeter and wherein no liquid phase is produced in the layer during the first heating step or the second heating step.

17. A method as claimed in claim 16 in which the thickness of the layer is at least 5 millimeters.

18. A method of producing a coating resistant to at least one of wear and corrosion from coating material comprising hard metallic alloys on a surface of a substrate made of at least one metal and ceramic comprising bonding together with an organic binder the coating material in powder form to provide a layer of powder grains bonded together with said organic binder on said surface;

enclosing said surface and said layer in a gas-tight jacket;

subjecting said layer of bonded powder grains enclosed by said jacket to a first heating step during which said binder is decomposed, whereby a rudimentary coating comprising said powder grains and decomposed binder is formed on said surface; and subjecting said rudimentary coating on said surface enclosed by said jacket to a second heating step in conjunction with the application of isostatic super-atmospheric pressure to densify said rudimentary coating by isostatic hot pressing of said powder grains to permanently adhere the densified rudimentary coating to said surface to form said resistant coating, wherein no liquid phase is produced in the layer during the first heating step or the second heating step.

19. A method as claimed in claim 18 wherein said jacket is being evacuated during said first heating step.

20. A method as claimed 18 comprising a cooling step between said first and second heating steps.

21. A method as claimed in claim 18 wherein said first heating step is conducted in a furnace, and said first heating step comprises a soak period during which a super-atmospheric pressure is maintained in said furnace.

22. A method a claimed in claim 18 in which said pressure in said furnace during said soak period is substantially 200 bar.

* * * * *